US011335139B1

(12) United States Patent
Brunda

(10) Patent No.: US 11,335,139 B1
(45) Date of Patent: May 17, 2022

(54) SYSTEM AND METHOD FOR SELECTIVE VEHICLE DATA RETRIEVAL

(71) Applicant: Bruce B. Brunda, Irvine, CA (US)

(72) Inventor: Bruce B. Brunda, Irvine, CA (US)

(73) Assignee: Innova Electronics Corporation, Irvine, CA (US)

( * ) Notice: Subject to any disclaimer, the term of this patent is extended or adjusted under 35 U.S.C. 154(b) by 0 days.

(21) Appl. No.: 17/458,154

(22) Filed: Aug. 26, 2021

(51) Int. Cl.
*G07C 5/08* (2006.01)
*G07C 5/00* (2006.01)

(52) U.S. Cl.
CPC ..... *G07C 5/0816* (2013.01); *G07C 5/008* (2013.01); *G07C 5/0808* (2013.01)

(58) Field of Classification Search
CPC ..... G07C 5/0816; G07C 5/008; G07C 5/0808
See application file for complete search history.

(56) References Cited

U.S. PATENT DOCUMENTS

| | | | |
|---|---|---|---|
| 5,020,135 | A | 5/1991 | Kasparian et al. |
| D334,560 | S | 4/1993 | Wilson |
| 5,347,211 | A | 9/1994 | Jakubowski |
| 5,499,182 | A | 3/1996 | Ousborne |
| 5,541,840 | A | 7/1996 | Krzysztof et al. |
| D377,622 | S | 1/1997 | Chen et al. |
| 5,623,922 | A | 4/1997 | Smith |
| 5,635,841 | A | 6/1997 | Taylor |
| 5,671,141 | A | 9/1997 | Smith et al. |
| 5,758,300 | A | 5/1998 | Abe |
| 5,767,681 | A | 6/1998 | Huang |
| 5,794,164 | A | 8/1998 | Beckert et al. |
| 5,808,907 | A | 9/1998 | Shetty et al. |
| 5,809,437 | A | 9/1998 | Breed |
| 5,848,365 | A | 12/1998 | Coverdill |
| 5,859,628 | A | 1/1999 | Ross et al. |

(Continued)

FOREIGN PATENT DOCUMENTS

| | | | |
|---|---|---|---|
| KR | 100456024 | B1 | 10/2004 |
| WO | 1999023783 | A2 | 10/1998 |

(Continued)

OTHER PUBLICATIONS

SPX Corporation, Genisys Evo catalog, 2011, 8 pages.

*Primary Examiner* — Michael V Kerrigan
(74) *Attorney, Agent, or Firm* — Stetina Brunda Garred & Brucker

(57) ABSTRACT

A method of mobile application-based vehicle diagnostics comprises establishing a user profile associated with a user of a mobile communication device, the profile including a vehicle identification number (VIN) associated with a vehicle operated by the user, receiving an instruction to obtain vehicle condition information, determining a geolocation of the device, in response to the instruction, directing the user to a nearby diagnostic service provider having a capability to retrieve diagnostic data including the VIN from the registered vehicle and upload the retrieved diagnostic data to a server or other data processor associated with a diagnostic database for deriving vehicle condition information from retrieved diagnostic data, receiving the vehicle condition information from the server, the vehicle condition information having been derived from the diagnostic data uploaded by the diagnostic service provider and associated with the user based on the VIN included in the diagnostic data, and displaying the received vehicle condition information on the device.

51 Claims, 5 Drawing Sheets

(56) References Cited

U.S. PATENT DOCUMENTS

| | | | |
|---|---|---|---|
| 5,884,202 | A | 3/1999 | Arjomand |
| 6,000,413 | A | 12/1999 | Chen |
| 6,052,631 | A | 4/2000 | Busch et al. |
| 6,055,468 | A | 4/2000 | Kaman et al. |
| 6,094,609 | A | 7/2000 | Arjomand |
| 6,104,988 | A | 8/2000 | Klarer |
| 6,225,898 | B1 | 5/2001 | Kamiya et al. |
| 6,263,268 | B1 | 7/2001 | Nathanson |
| 6,295,492 | B1 | 9/2001 | Lang et al. |
| 6,314,422 | B1 | 11/2001 | Barker et al. |
| 6,389,337 | B1 | 5/2002 | Kolls |
| 6,438,471 | B1 | 8/2002 | Katagishi et al. |
| 6,442,460 | B1 | 8/2002 | Larson et al. |
| 6,499,385 | B2 | 12/2002 | Protti |
| 6,535,112 | B1 | 3/2003 | Rothschink |
| 6,587,768 | B2 | 7/2003 | Chene et al. |
| 6,611,740 | B2 | 8/2003 | Lowrey et al. |
| 6,650,318 | B1 | 11/2003 | Arnon |
| 6,718,425 | B1 | 4/2004 | Pajakowski et al. |
| 6,732,031 | B1 | 5/2004 | Lightner et al. |
| 6,738,697 | B2 | 5/2004 | Breed |
| 6,768,935 | B1 | 7/2004 | Morgan et al. |
| 6,807,469 | B2 | 10/2004 | Funkhouser et al. |
| 6,836,708 | B2 | 12/2004 | Tripathi |
| 6,847,916 | B1 | 1/2005 | Ying |
| 6,868,369 | B2 | 3/2005 | Huang et al. |
| 6,925,368 | B2 | 8/2005 | Funkhouser et al. |
| 6,940,270 | B2 | 9/2005 | Chen |
| D510,287 | S | 10/2005 | Chen et al. |
| 6,957,133 | B1 | 10/2005 | Hunt et al. |
| 6,968,733 | B2 | 11/2005 | Andreasen et al. |
| 7,030,742 | B2 | 4/2006 | Treadway |
| 7,085,680 | B2 | 8/2006 | Huang |
| 7,089,099 | B2 | 8/2006 | Shostak et al. |
| 7,103,460 | B1 | 9/2006 | Breed |
| 7,116,216 | B2 | 10/2006 | Andreasen et al. |
| 7,209,813 | B2 | 4/2007 | Namaky |
| D545,223 | S | 6/2007 | Chen |
| D558,621 | S | 1/2008 | Rich et al. |
| D559,137 | S | 1/2008 | Protti |
| D560,129 | S | 1/2008 | Rich et al. |
| D560,527 | S | 1/2008 | Rich et al. |
| 7,325,775 | B2 | 2/2008 | Chen |
| D563,249 | S | 3/2008 | Chen |
| 7,363,149 | B2 | 4/2008 | Klausner et al. |
| D569,280 | S | 5/2008 | Chen |
| 7,376,497 | B2 | 5/2008 | Chen |
| D571,241 | S | 6/2008 | Andreasen et al. |
| 7,409,317 | B2 | 8/2008 | Cousin et al. |
| 7,421,321 | B2 | 9/2008 | Breed et al. |
| 7,437,227 | B2 | 10/2008 | Andreasen et al. |
| D581,822 | S | 12/2008 | Madison et al. |
| 7,464,000 | B2 | 12/2008 | Huang |
| D590,387 | S | 4/2009 | Chen |
| 7,520,668 | B2 | 4/2009 | Chen |
| 7,603,293 | B2 | 10/2009 | Chenn |
| 7,620,484 | B1 | 11/2009 | Chen |
| D610,586 | S | 2/2010 | Chen |
| 7,778,750 | B2 | 8/2010 | Knight et al. |
| D624,446 | S | 9/2010 | Chen et al. |
| D624,838 | S | 10/2010 | Chen et al. |
| D625,209 | S | 10/2010 | Chen et al. |
| D625,210 | S | 10/2010 | Chen et al. |
| D625,634 | S | 10/2010 | Chen et al. |
| 7,904,219 | B1 | 3/2011 | Lowrey et al. |
| 8,019,503 | B2 | 9/2011 | Andreasen et al. |
| 8,024,083 | B2 | 9/2011 | Chenn |
| D646,188 | S | 10/2011 | Chen et al. |
| D646,599 | S | 10/2011 | Chen et al. |
| 8,032,419 | B2 | 10/2011 | Chenn |
| 8,068,951 | B2 | 11/2011 | Chen et al. |
| 8,131,417 | B2 | 3/2012 | Picard |
| 8,301,329 | B2 | 10/2012 | Andreasen et al. |
| 8,306,687 | B2 | 11/2012 | Chen |
| 8,370,018 | B2 | 2/2013 | Andreasen et al. |
| 8,509,986 | B1 | 8/2013 | Chen |
| 8,630,765 | B2 | 1/2014 | Chen |
| 8,825,271 | B2 | 9/2014 | Chen |
| 8,855,621 | B2 | 10/2014 | Chen |
| 8,862,117 | B2 | 10/2014 | Chen |
| 8,909,416 | B2 | 12/2014 | Chen et al. |
| 9,002,554 | B2 | 4/2015 | Chen |
| 9,014,908 | B2 | 4/2015 | Chen et al. |
| 9,026,400 | B2 | 5/2015 | Chen et al. |
| 9,177,428 | B2 | 11/2015 | Nguyen et al. |
| 9,646,432 | B2 | 5/2017 | Madison et al. |
| 10,643,403 | B2 | 5/2020 | Madison et al. |
| 2001/0033225 | A1 | 10/2001 | Razavi et al. |
| 2002/0007237 | A1 | 1/2002 | Phung et al. |
| 2002/0010541 | A1 | 1/2002 | Houston et al. |
| 2002/0035421 | A1 | 3/2002 | Warkentin |
| 2003/0171111 | A1 | 9/2003 | Clark |
| 2004/0110472 | A1 | 6/2004 | Witkowski et al. |
| 2004/0227523 | A1 | 11/2004 | Namaky |
| 2005/0192727 | A1 | 9/2005 | Shostak et al. |
| 2009/0276115 | A1 | 11/2009 | Chen |
| 2011/0071720 | A1 | 3/2011 | Schondorf et al. |
| 2011/0123039 | A1 | 5/2011 | Hirschfeld et al. |
| 2011/0224866 | A1 | 9/2011 | Chen |
| 2011/0264322 | A1 | 10/2011 | Chen |
| 2011/0307144 | A1 | 12/2011 | Wu et al. |
| 2012/0215398 | A1 | 8/2012 | Chen et al. |
| 2013/0297143 | A1 | 11/2013 | Chen et al. |
| 2014/0046800 | A1 | 2/2014 | Chen |
| 2014/0052328 | A1 | 2/2014 | Nguyen et al. |
| 2019/0304208 | A1 | 10/2019 | Chen et al. |
| 2019/0304213 | A1 | 10/2019 | Chen et al. |

FOREIGN PATENT DOCUMENTS

| | | | |
|---|---|---|---|
| WO | 1998051991 | A1 | 11/1998 |
| WO | 2001086576 | A1 | 11/2001 |

SYSTEM AND METHOD FOR SELECTIVE VEHICLE DATA RETRIEVAL

CROSS-REFERENCE TO RELATED APPLICATIONS

Not Applicable

STATEMENT RE: FEDERALLY SPONSORED RESEARCH/DEVELOPMENT

Not Applicable

BACKGROUND

Technical Field

The present disclosure relates to vehicle diagnostic products and services, and more particularly, to a method, system, and application program directed to retrieving, retaining and utilizing vehicle specific diagnostic information using either an on-board device for communicating with the vehicle diagnostic system, or, where no such device is available, using a network of diagnostic service providers that retrieve and upload the vehicle data to a processor operative to detect and aggregate all vehicle data received from one or more registered vehicles.

Related Art

Due to the complexity of automotive technology, the rough handling that a vehicle ordinarily endures, and the importance of safety and performance to vehicle owners, vehicle ownership invariably requires periodic servicing of the vehicle. To most vehicle owners, servicing the vehicle entails bringing the vehicle to an expert, typically either a dealership or a trusted, independent auto mechanic. To some do-it-yourselfers (DIYers), servicing the vehicle may entail diagnosing the vehicle using state-of-the-art vehicle diagnostics technology that is compatible with automotive scan tools and consumer mobile devices such as smartphones, for example, and then purchasing auto parts to perform the necessary repairs oneself. In any case, there are occasions when it becomes necessary to seek service and/or part providers outside the habitual patterns of the vehicle owner. This is true even for the most passionate DIYer or the most risk-averse vehicle owner who consistently takes his or her vehicle to the dealership where it was purchased. Cars break down unexpectedly requiring roadside assistance, rare or difficult-to-diagnose defects are encountered, and vehicle owners travel far from their usual service and part providers. Moreover, vehicles change owners, with the different owners having different preferences and habits. As a result, during the life of a vehicle, the many accumulated repair and/or diagnostic "events" will have occurred at a wide variety of locations and will have been handled by a vast array of disparate service providers.

From the perspective of any one automotive service provider who might wish to establish a lasting relationship with the vehicle owner, this makes it exceedingly difficult to acquire and maintain a thorough understanding of the vehicle's condition and history. For example, a provider of automotive diagnostic and repair services might want to provide value to its customers by offering individually tailored services and enhanced diagnostics that take into account information about each particular vehicle. To do this, they might use loyalty and reward programs to entice the vehicle owner to always take the vehicle to them for repairs and/or parts. However, this approach inevitably fails in the long term as the vehicle owner is forced to take the vehicle elsewhere by events outside his or her control. Another approach that may be taken is to encourage the customer to purchase a scan tool or other device that the customer can use to diagnose the vehicle by himself or herself. The service provider can then maintain a proprietary database of vehicle condition reports derived from customer diagnostic data that is retrieved from the customers' vehicles and uploaded using the scan tools. However, these devices are expensive and not likely to be bought by the average consumer, making it difficult to build such a database for a significant portion of the customer base. Service providers are left with two unsatisfactory outcomes: on the one hand, providing enhanced services to only a small portion of the customer base and, on the other, providing more generic (and less valuable) services to the majority of customers. This unfortunate state of affairs can be seen if one looks at the automotive mobile applications that exist on the market today. Though such apps purport to provide targeted assistance to all vehicle owners, they either require a connection to a vehicle ECU using a dongle or other data acquisition device or else offer little more than generic information that is of little value to a driver in need of assistance.

From the vehicle owner's perspective, the problem is greater still. Vehicle owners want the same individualized services that the service providers would like to provide them with, and, for the most part, they would prefer not to have to buy additional devices besides the smartphones that they already have. But in addition, even for those vehicle owners who would be willing to buy a scan tool or dongle and upload diagnostic data to a service provider's database, there are times when the vehicle owner would prefer not to use this device and would rather seek expert assistance. For example, the vehicle owner may find the dongle inconvenient to use because it drains the vehicle battery if it is left plugged into the OBD port while the vehicle is off. Not wanting to have to remember to unplug the dongle every time he or she turns off the vehicle (and plug it back in when the vehicle is in use), the customer may decide to forgo the use of the dongle altogether or may decide that it is sometimes worth using but other times not. As another example, the vehicle owner may want to obtain multiple scans of their vehicle diagnostic data to notice any differences or trends in the operation of vehicle systems, that may indicate a defect condition is deteriorating further. Further, a vehicle owner may simply want a second opinion and may seek diagnostic services of an expert mechanic in addition to the scan that the vehicle owner performed himself or herself. In general, vehicle owners want the freedom to choose how, when, and where to diagnose and service their vehicles using a common diagnostic portal that integrates vehicle information obtained at different diagnostic service providers, that can all be accessed by the vehicle owner using a single application program. This is something that conventional models cannot provide, even to those customers willing to purchase a scan tool or dongle.

Moreover, vehicle owners want to keep a record of their own data. Even when conventional systems work as intended, e.g., with each customer diagnosing his or her own vehicle and uploading the resulting data to build an individualized record, the resulting record is typically not readily accessible to the customer. For example, the vehicle owner may want to view a past vehicle condition report and forward the report to a trusted auto mechanic for further recommendations. Assuming that it is possible for the vehicle owner to see this information at all, the vehicle owner may typically have to contact the service provider via customer service channels in order to gain access to the information. From the perspective of the vehicle owner, who is unconcerned with the business needs of the service provider, it would be better if all the information about his or her vehicle were always at the vehicle owner's fingertips, accessible within a mobile app for any purpose the vehicle owner may have in mind.

The ideal system would solve all of the above problems. A vehicle owner should be free to decide whether to diagnose his or her own vehicle using a scan tool or dongle or to take the vehicle to an expert mechanic of his or her choice. The decision should be made freely depending on the circumstances, with the vehicle owner perhaps choosing one route one day and another route the next. If the vehicle does not own or does not choose to use a scan tool or dongle, the app should assist the user with finding a vehicle diagnostics services provider to scan the vehicle. Regardless of how and where the vehicle owner seeks diagnostic and repair services, buys auto parts, or requests roadside assistance, all of the resulting diagnostic data and derived vehicle condition reports should be made available to the user automatically or on demand over the vehicle owner's smart phone or other mobile device. An app installed on the device should make use of all of this accumulated information to provide targeted recommendations to the vehicle owner that are specific to the vehicle including its up-to-date diagnostic condition information collected from disparate sources. The app should empower the vehicle owner while at the same time benefiting business owners by driving vehicle owners to local auto mechanics, parts stores, and roadside assistance service providers.

BRIEF SUMMARY

The present disclosure contemplates various systems and methods for overcoming the above drawbacks accompanying the related art. The present disclosure addresses a need for a diagnostic network architecture that allows app users to aggregate their vehicle diagnostic data and derived vehicle condition information in a common storage area, where it can be accessed, analyzed and acted on by the app user. Preferably such aggregation may be implemented, on an ongoing basis, independent of any user interaction with the app user interface. User activity would be limited to providing an instruction to obtain a diagnostic information scan and selecting a nearby diagnostic service provider that provides a diagnostic data inspection (preferably free of charge), which uploads the diagnostic information to a processor that, in addition to returning the diagnostic report to the providing diagnostic service provider, also detects diagnostic data/information associated with a registered vehicle and routes the data/information to the user, or to a storage location associated with the user. The intended result is to enable the generation of a diagnostic report for a vehicle, that doesn't have a dongle or other data access and transfer device, that essentially replicates a report generated for a vehicle having an associated data collecting dongle or other device.

One aspect of the embodiments of the present disclosure is a non-transitory program storage medium on which are stored instructions executable by a processor or programmable circuit of a mobile communication device to perform operations for mobile application-based vehicle diagnostics. The operations may comprise establishing a user profile associated with a user of the mobile communication device, the profile including an SMS-enabled phone number associated with the user and a vehicle identification number (VIN) associated with a registered vehicle operated by the user, and receiving, at a mobile communication device, a first instruction to obtain vehicle condition information associated with the registered vehicle. The operations may further comprise determining a first geolocation of the mobile communication device and, in response to the first instruction, directing the user of the mobile communication device to a specified diagnostic service provider (such as an automotive parts retailer or a repair shop) having a capability to retrieve diagnostic data including the VIN from the registered vehicle and upload the retrieved diagnostic data to a server associated with a diagnostic database for deriving vehicle condition information from retrieved diagnostic data. Directing the user may include receiving, at the mobile communication device, a geolocation of the specified diagnostic service provider in relation to the first geolocation of the mobile communication device and displaying the geolocation of the specified diagnostic service provider on the mobile communication device. The operations may further comprise receiving the vehicle condition information from the server, the vehicle condition information having been specifically derived for the registered vehicle from the diagnostic data uploaded by the specified diagnostic service provider and associated with the user based on the VIN included in the retrieved diagnostic data or otherwise input on the mobile communication device, and displaying the received vehicle condition information for the registered vehicle on the mobile communication device.

The receiving of the geolocation of the specified diagnostic service provider may include receiving geolocations of a plurality of diagnostic service providers including the specified diagnostic service provider in relation to the first geolocation of the mobile communication device. The directing may include receiving, via user input to the mobile communication device, a selection of the specified diagnostic service provider from among the plurality of diagnostic service providers. The displaying of the geolocation of the specified diagnostic service provider may be in response to the selection. The plurality of diagnostic service providers may be determined based on the respective geolocations of the diagnostic service providers being within a threshold distance or travel time from the first geolocation of the mobile communication device.

The displaying of the vehicle condition information may include displaying an indication of an urgency level associated with the vehicle condition information.

The operations may comprise, after the displaying of the received vehicle condition information, receiving a user request for past vehicle condition information associated with the user profile, and, in response to the user request, displaying the vehicle condition information on the mobile communication device. The operations may comprise, in response to the user request, accessing the user profile to retrieve the vehicle condition information, the vehicle condition information being stored in association with the user profile. The accessing may comprise accessing the user profile at the server. The accessing may comprise accessing the user profile on the mobile communication device.

The first instruction may be received via user input to the mobile communication device.

The operations may comprise receiving, at the mobile communication device, a second instruction to identify an auto repair service provider to repair a defect indicated by the vehicle condition information, determining a second geolocation of the mobile communication device, and, in response to the second instruction, directing the user of the mobile communication device to a specified auto repair service provider having a capability to repair the defect. The directing of the user to the specified auto repair service provider may include receiving, at the mobile communication device, a geolocation of the specified auto repair service provider in relation to the second geolocation of the mobile communication device and displaying the geolocation of the specified auto repair service provider on the mobile communication device. The receiving of the geolocation of the specified auto repair service provider may include receiving geolocations of a plurality of auto repair service providers including the specified auto repair service provider in relation to the second geolocation of the mobile communication device. The directing of the user to the specified auto repair service provider may further include receiving, via user input to the mobile communication device, a selection of the specified auto repair service provider from among the plurality of auto repair service providers. The displaying of the geolocation of the specified auto repair service provider may be in response to the selection. The operations may comprise displaying, in association with at least one of the plurality of auto repair service providers, a cost to repair the defect. The operations may comprise, after the displaying of the geolocation of the specified auto repair service provider, receiving, from the server, transaction information associated with a repair service rendered by the specified auto repair service provider in association with the registered vehicle and displaying the transaction information on the mobile communication device.

The operations may further comprise receiving, at the mobile communication device, a second instruction to identify an auto parts provider to provide auto parts for repairing a defect indicated by the vehicle condition information, determining a second geolocation of the mobile communication device, and, in response to the second instruction, directing the user of the mobile communication device to a specified auto parts provider having parts suitable to repair the defect. The directing of the user to the specified auto parts provider may include receiving, at the mobile communication device, a geolocation of the specified auto parts provider in relation to the second geolocation of the mobile communication device and displaying the geolocation of the specified auto parts provider on the mobile communication device. The receiving of the geolocation of the specified auto parts provider may include receiving geolocations of a plurality of auto parts providers including the specified auto parts provider in relation to the second geolocation of the mobile communication device. The directing of the user to the specified auto parts provider may further include receiving, via user input to the mobile communication device, a selection of the specified auto parts provider from among the plurality of auto parts providers. The displaying of the geolocation of the specified auto parts provider may be in response to the selection. The operations may comprise displaying, in association with at least one of the plurality of auto parts providers, a cost of the parts. The operations may comprise, after the displaying of the geolocation of the specified auto parts provider, receiving, from the server, transaction information associated with parts purchased from the specified auto parts provider in association with the registered vehicle and displaying the transaction information on the mobile communication device.

The operations may further comprise receiving, at the mobile communication device, a second instruction to identify a roadside assistance service provider to assist with repairing a defect indicated by the vehicle condition information, determining a second geolocation of the mobile communication device, and, in response to the second instruction, directing the user of the mobile communication device to a specified roadside assistance service provider having a capability to provide roadside assistance in relation to the defect. The directing of the user to the specified roadside assistance service provider may include receiving, at the mobile communication device, contact information of the specified roadside assistance service provider in relation to the second geolocation of the mobile communication device and displaying the contact information of the specified roadside assistance service provider on the mobile communication device. The receiving of the contact information of the specified roadside assistance service provider may include receiving contact information of a plurality of roadside assistance service providers including the specified roadside assistance service provider in relation to the second geolocation of the mobile communication device. The directing of the user to the specified roadside assistance service provider may include receiving, via user input to the mobile communication device, a selection of the specified roadside assistance service provider from among the plurality of roadside assistance service providers. The displaying of the contact information of the specified roadside assistance service provider may be in response to the selection. The operations may further comprise displaying, in association with at least one of the plurality of roadside assistance service providers, a cost to provide roadside assistance in relation to the defect. The operations may further comprise, after the displaying of the geolocation of the specified roadside assistance service provider, receiving, from the server, transaction information associated with a roadside assistance service rendered by the specified roadside assistance service provider in association with the registered vehicle and displaying the transaction information on the mobile communication device.

The vehicle condition information associated with the registered vehicle may include an estimated cost associated with repairing a defect indicated by the vehicle condition information.

The retrieved diagnostic data may include at least one selected from the group consisting of a diagnostic trouble code (DTC), vehicle sensor data, freeze frame data, and live data.

The first instruction may comprise a request for symptomatic diagnosis. The operations may further comprise receiving, via user input to the mobile communication device, information identifying at least one symptom associated with the registered vehicle, accessing vehicle identifying information of the registered vehicle, deriving symptomatic diagnostic condition information of the registered vehicle from the at least one symptom and the vehicle identifying information, and displaying the symptomatic diagnostic condition information on the mobile communication device. The deriving of the symptomatic diagnostic condition information may comprise receiving, from the server, vehicle condition information associated with the user profile corresponding to the user and deriving the symptomatic diagnostic condition information from the at least one symptom, the vehicle identifying information, and the vehicle condition information associated with the user profile. The accessing may comprise accessing the vehicle identifying information at the server. The accessing may comprise accessing the vehicle identifying information on the mobile communication device.

The operations may further comprise receiving the diagnostic data from the server.

The operations may further comprise receiving a notification on the mobile communication device that the vehicle condition information is available for review. The notification may contain a link. The displaying of the received vehicle condition information may be in response to a user interaction with the link.

The diagnostic data may be retrieved by the specified diagnostic service provider from a vehicle diagnostic port disposed on the registered vehicle.

The retrieved vehicle diagnostic data may comprise an OBD diagnostic payload retrieved by the specified diagnostic service provider from a vehicle diagnostic port disposed on the registered vehicle.

Another aspect of the embodiments of the present disclosure is a non-transitory program storage medium on which are stored instructions executable by a processor or programmable circuit of a mobile communication device to perform operations for mobile application-based vehicle diagnostics. The operations may comprise receiving, at a mobile communication device, a first instruction to obtain vehicle condition information associated with the registered vehicle, determining whether a data acquisition and transfer device (DAT) for connecting the mobile communication device to a diagnostics port of a registered vehicle is present, setting an operation mode to a first mode in response to a determination that the DAT is not present, and setting the operation mode to a second mode in response to a determination that the DAT is present. The operations may further comprise, when the operation mode is set to the first mode, determining a first geolocation of the mobile communication device and, in response to the first instruction, performing suboperations comprising directing the user of the mobile communication device to a specified diagnostic service provider in relation to the first geolocation, the specified diagnostic service provider having a capability to retrieve diagnostic data including a vehicle identification number (VIN) from the registered vehicle and upload the retrieved diagnostic data to a server associated with a diagnostic database for deriving vehicle condition information from retrieved diagnostic data, receiving, at the mobile communication device, a geolocation of the specified diagnostic service provider in relation to the first geolocation of the mobile communication device, and displaying the geolocation of the specified diagnostic service provider on the mobile communication device. The operations may further comprise, when the operation mode is set to the second mode, retrieving vehicle diagnostic data including the vehicle identification number (VIN) from the registered vehicle via the DAT in response to the first instruction and uploading, from the mobile communication device to the server, the diagnostic data retrieved via the DAT, receiving the vehicle condition information from the server, the vehicle condition information having been derived from the diagnostic data uploaded either by the specified diagnostic service provider or by the mobile communication device and associated with the user based on the VIN included in the diagnostic data, and displaying the received vehicle condition information for the registered vehicle on the mobile communication device.

When the operation mode is set to the second mode, the first instruction may be automatically generated based on data passively collected from the registered vehicle by the DAT. When the operation mode is set to the second mode, the first instruction may be automatically generated based on an urgency associated with the passively collected data. The passively collected data may include a diagnostic trouble code (DTC). When the operation mode is set to the second mode, the first instruction may be automatically generated on a periodic basis. The determining of whether the DAT is present may comprise detecting a connection between the mobile communication device and the DAT.

Another aspect of the embodiments of disclosure is a method of providing mobile application-based vehicle diagnostics. The method may comprise establishing a user profile associated with a user of the mobile communication device, the profile including an SMS-enabled phone number associated with the user and a vehicle identification number (VIN) or other vehicle identifying information (e.g. year/make/model/engine information) associated with a registered vehicle operated by the user, and receiving, at a mobile communication device, a first instruction to obtain vehicle condition information associated with the registered vehicle. The method may further comprise determining a first geolocation of the mobile communication device and, in response to the first instruction, directing the user of the mobile communication device to a specified diagnostic service provider having a capability to retrieve diagnostic data including the VIN from the registered vehicle and upload the retrieved diagnostic data to a server associated with a diagnostic database for deriving vehicle condition information from retrieved diagnostic data. Directing the user may include receiving, at the mobile communication device, a geolocation of the specified diagnostic service provider in relation to the first geolocation of the mobile communication device and displaying the geolocation of the specified diagnostic service provider on the mobile communication device. The method may further comprise receiving the vehicle condition information from the server, the vehicle condition information having been derived from the diagnostic data uploaded by the specified diagnostic service provider and associated with the user based on the VIN included in the diagnostic data, and displaying the received vehicle condition information for the registered vehicle on the mobile communication device.

Another aspect of the embodiments of the present disclosure is a method of providing mobile application-based vehicle diagnostics. The method may comprise establishing a user profile associated with a user of a mobile communication device, the profile including an SMS-enabled phone number associated with the user and a vehicle identification number (VIN) associated with a registered vehicle operated by the user, and enabling the mobile communication device to receive a first instruction to obtain vehicle condition information associated with the registered vehicle. The method may further comprise enabling the mobile communication device to determine a first geolocation of the mobile communication device and enabling the mobile communication device to, in response to the first instruction, direct the user of the mobile communication device to a specified diagnostic service provider having a capability to retrieve diagnostic data including the VIN from the registered vehicle and upload the retrieved diagnostic data to a server associated with a diagnostic database for deriving vehicle condition information from retrieved diagnostic data. The directing may include receiving, at the mobile communication device, a geolocation of the specified diagnostic service provider in relation to the first geolocation of the mobile communication device and displaying the geolocation of the specified diagnostic service provider on the mobile communication device. The method may further comprise enabling the mobile communication device to receive the vehicle condition information from the server, the vehicle condition information having been derived from the diagnostic data uploaded by the specified diagnostic service provider and associated with the user based on the VIN included in the diagnostic data, and enabling the mobile communication device to display the received vehicle condition information for the registered vehicle on the mobile communication device.

Another aspect of the embodiments of the present disclosure is a system for providing mobile application-based vehicle diagnostics. The system may comprise a mobile communication device having an installed mobile application, the mobile application operable to receive a first instruction to obtain vehicle condition information associated with a registered vehicle, determine a first geolocation of the mobile communication device, receive a geolocation of a specified diagnostic service provider in relation to the first geolocation of the mobile communication device in response to the first instruction, and display the geolocation of the specified diagnostic service provider on the mobile communication device. The system may further comprise at least one server in communication with the mobile communication device, the at least one server operable to establish a user profile associated with a user of the mobile communication device and including a vehicle identification number (VIN) associated with the registered vehicle, receive diagnostic data retrieved by the specified diagnostic service provider from the registered vehicle, detect a VIN within the diagnostic data, derive vehicle condition information from the received diagnostic data, associate the vehicle condition information with the user profile by matching a VIN included in the received diagnostic data with the VIN included in the user profile, and provide the vehicle condition information to the mobile application. The mobile application may display the vehicle condition information on the mobile communication device.

The mobile application may determine a second geolocation of the mobile communication device (e.g. at the location of the specified diagnostic service provider or at the user's home), and the at least one server may provide the mobile communication device with a geolocation of one or more auto repair service providers in relation to the second geolocation of the mobile communication device, the specified (selected) auto repair service provider having a capability to repair a defect indicated by the vehicle condition information. The at least one server may provide the vehicle condition information to the specified auto repair service provider.

The mobile application may determine a second geolocation of the mobile communication device, and the at least one server may provide the mobile communication device with a geolocation of a specified auto parts provider in relation to the second geolocation of the mobile communication device, the specified auto parts provider having a part suitable to repair a defect indicated by the vehicle condition information. The at least one server may provide the vehicle condition information to the specified auto parts provider.

The mobile application may determine a second geolocation of the mobile communication device, and the at least one server may provide the mobile communication device with contact information of a specified roadside assistance service provider in relation to the second geolocation of the mobile communication device, the specified roadside assistance service provider having a capability to provide roadside assistance in relation to a defect indicated by the vehicle condition information. The at least one server may provide the vehicle condition information to the specified roadside assistance service provider.

The at least one server may store the vehicle condition information in the user profile. The mobile application may be operable to receive a user request for the vehicle condition information stored in the user profile and, in response to the user request, retrieve the vehicle condition stored in the user profile and display the retrieved vehicle condition information on the mobile communication device The first instruction may be automatically generated based on an urgency level associated with information included in the user profile.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of systems and methods for mobile application-based vehicle diagnostics. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
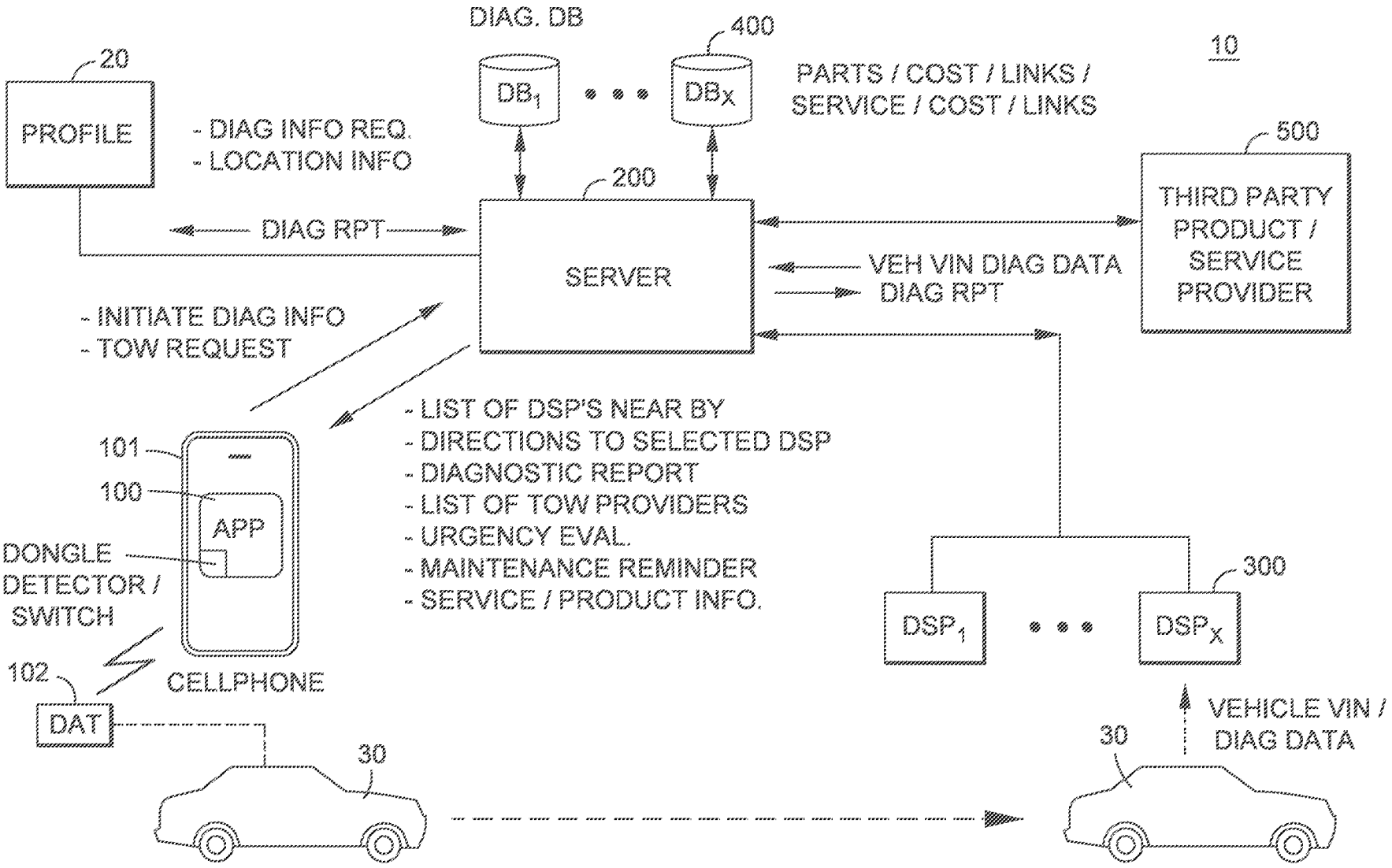
FIG. 1 shows a system for selective vehicle data retrieval according to an embodiment of the present disclosure.

FIG. 1 shows an exemplary system 10 for selective vehicle data retrieval according to an embodiment of the present disclosure. A vehicle owner may install a mobile application ("app") 100 on his or her smartphone or other mobile communication device 101 and establish a user profile 20 including a vehicle identification number (VIN) associated with the vehicle owner's vehicle 30. The app 100 may serve as the vehicle owner's gateway for all automotive needs, whether the vehicle owner wishes to diagnose the vehicle 30 (e.g. either to address some symptom or as a precaution before a road trip, for example), service the vehicle 30, review and transact with past vehicle condition information and service reports, or get immediate assistance (such as when the vehicle 30 breaks down). To this end, a server 200 in communication with the mobile communication device 101 may receive various requests from the app 100 and respond by providing targeted assistance, recommendations, and other information to the app 100 to meet the vehicle owner's particular need.

In order to provide such information targeted to the particular vehicle 30 and vehicle owner, the server 200 may manage the vehicle owner's user profile 20, which may be stored in a database of user profiles 20 for many different users of the system 10, for example. Each time the vehicle 30 is scanned for diagnostic data, whether it is done by the vehicle owner's own data acquisition and transfer device (DAT) 102 or by a scan tool belonging to a third-party diagnostic service provider 300 ($DSP_1, \ldots, DSP_X$), the retrieved diagnostic data may be uploaded to the server 200 for diagnostic analysis using one or more diagnostic databases 400 ($DB_1, \ldots, DB_X$). A diagnosis, defect, most likely fix, or other vehicle condition information may thus be returned to the vehicle owner or the third-party diagnostic service provider 300. However, unlike in the case of conventional diagnostic systems, the VIN included in the uploaded diagnostic data may further be used to associate the event with the user profile 20 that includes the same VIN. In this way, the server 200 may leverage the conventional processes of existing diagnostic service providers to accumulate individualized information in each user profile 20, irrespective of where or by what means the vehicle 30 was diagnosed.

The individualized information stored in the user profile 20 may include the vehicle condition information that has been derived based on diagnostic data retrieved from the vehicle 20. Thus, even where a third-party diagnostic service provider 300 has performed the diagnostic scan, the vehicle owner may have full access to the resulting vehicle condition information (and the underlying diagnostic data itself) via the app 100, just as if the vehicle owner had performed the scan himself or herself. Such vehicle condition information derived from a most recent scan or from a past scan in relation to the vehicle 30 may be made available to the user via the app 100 on the screen of the mobile communication device 101, either automatically or on demand.

Upon reviewing vehicle condition information that indicates some defect in the vehicle 30, the vehicle owner may further use the app 100 to request individualized recommendations for appropriate service, parts, or roadside assistance. In this regard, the app 100 may suggest one or more third party repair service providers, auto parts providers, and/or roadside assistance providers (collectively third-party providers 500) based on the vehicle condition information and on the particular vehicle 30 as well as on current location data associated with the mobile communication device 101 or the vehicle 30. Because the app 100 has access to the user profile 20 (e.g. via the server 200), which may contain historical data associated with the vehicle 30 including vehicle owner preferences, the third-party providers 500 may in some cases be selected or ranked in an individualized manner not just for the particular defect and year/make/mode/trim but for the exact vehicle 30 in question and its owner. For example, the app 100 might prioritize third-party providers 500 that the vehicle owner has gone to (and has had positive experiences with) in the past. The app 100 may present a list of third-party providers 500 to the user, from which the vehicle owner may make a selection (e.g. based on cost, distance, etc.). The app 100 may then direct the vehicle owner to the selected third-party provider 500 (or provide contact information in the case of a roadside assistance provider) so that the vehicle owner can get the needed service, parts or roadside assistance.

Figure 2:
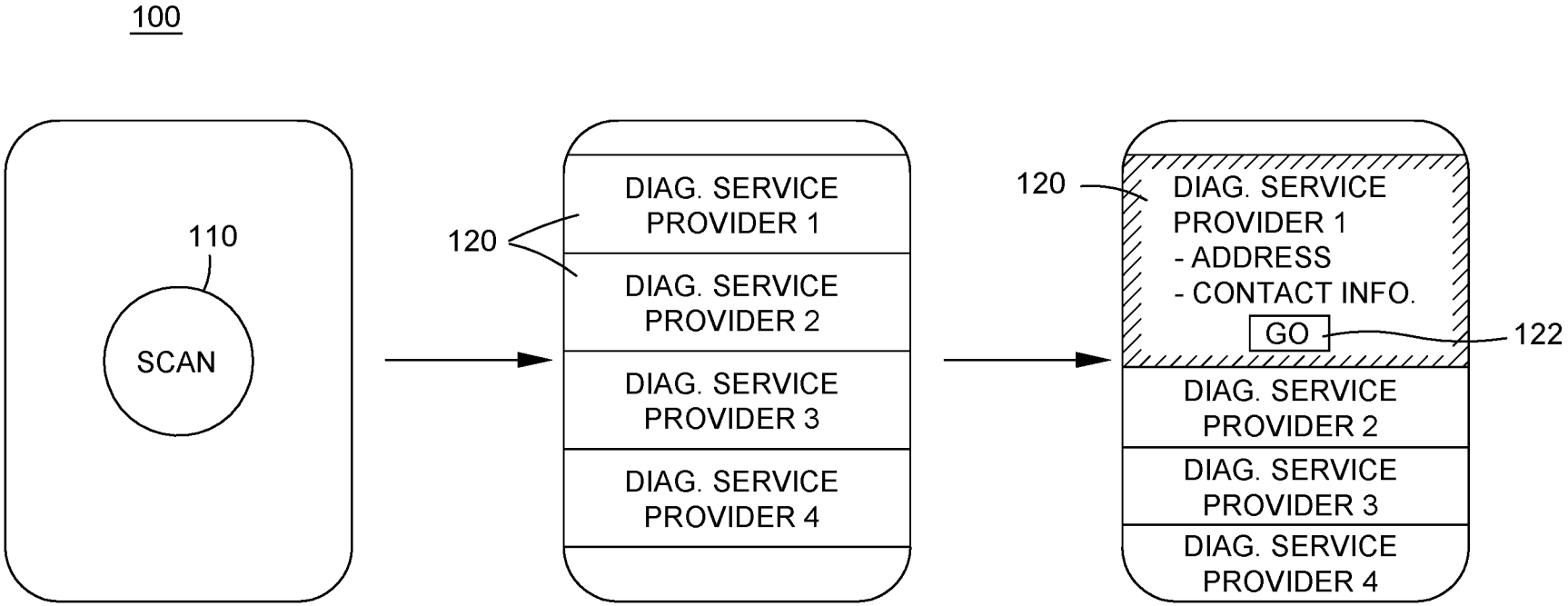
FIG. 2 shows a sequence of screenshots of a mobile application according to an embodiment of the present disclosure in relation to obtaining vehicle condition information.

FIG. 2 shows a sequence of screenshots of the app 100 in relation to obtaining vehicle condition information using the system 10. In the first (leftmost) view, the app 100 displays a scan button 110. As an example, consider a vehicle owner who is far from home, driving across country on a road trip. The vehicle owner begins to notice a recurring, unfamiliar sound coming from the engine (or, as another example, the check engine light becomes illuminated). Since the vehicle owner will soon be entering less populated areas where service options are fewer and farther between, the vehicle owner decides it would be wise to get the issue checked out sooner rather than later. The vehicle owner does not own a dongle or other DAT or scan tool but has the app 100 installed on his or her smartphone. Pulling over for a moment, the vehicle owner opens up the app 100 and taps the scan button 110.

In response to the vehicle owner's interaction with the scan button 110, the app 100 transitions to the second (center) view of FIG. 2, displaying a list of items 120, each one corresponding to a nearby diagnostic service provider 300 (see FIG. 1). Since the app 100 has already determined a geolocation of the vehicle owner's smartphone (either before or after the scan button 110 was tapped), the listed items 120 may represent those diagnostic service providers 300 that are nearby, e.g. those having a geolocation within a threshold distance of the geolocation of the smartphone or within a threshold travel time of the geolocation of the smartphone. Since the system 10 is also aware of the vehicle owner's particular vehicle 30 and the vehicle owner's personal preferences/history (as may all be included in the vehicle owner's user profile 20), it can be ensured that the listed diagnostic service providers 300 are all viable/preferred diagnostic service providers 300 for scanning the vehicle 30.

The vehicle owner reviews his or her options and taps the item 120 corresponding to his or her choice of diagnostic service provider 300, causing the app 100 to transition to the third (rightmost) view of FIG. 2, where additional details of the selected diagnostic service provider 300 may be displayed in an expanded version of the item 120. In the illustrated example, the expanded view shows address and contact information for the selected diagnostic service provider 300, whereas the collapsed view only showed the name of each diagnostic service provider 300 (though the list itself may provide information by ranking the diagnostic service providers 300 by distance, travel time, or other criteria, for example). With such an implementation, it is contemplated that the vehicle owner may need more information to make a decision and might expand and collapse several of the list items 120 before arriving at a decision. In general, the particular details that are displayed in the expanded and collapsed views may vary from implementation to implementation (or according to user preference settings), and in some cases there may be only a single view that includes all of the details for each list item 120 (possibly with links to external websites associated with each diagnostic service provider 300 if more information is needed). A button 122 may be provided in association with each item 120 (shown in FIG. 2 in the expanded/detail view only), which may initiate a navigation routine (e.g. via third-party application) to direct the vehicle owner from the current geolocation of the smartphone to the geolocation of the selected diagnostic service provider 300.

The vehicle owner is now on his or her way to a nearby diagnostic service provider 300, such as a service center, parts store, drive-up kiosk (e.g. at a gas station), or anywhere else that may have a scan tool or other means of connecting to the diagnostic port of the vehicle 30 and running a scan. The vehicle owner is happy to have been able to find a suitable diagnostic service provider 300 in a totally unfamiliar area, especially one that has been selected in accordance with the vehicle owner's own vehicle 30 and preferences. It should be noted that, in some cases, the diagnostic service provider 300 may be an individual owner of a scan tool who comes to the vehicle owner and performs the scan wherever the vehicle owner is located. In such a case, the button 122 associated with that particular diagnostic service provider 300 may instead initiate a call (e.g. via the smartphone's native calling functionality) or book an appointment (e.g. via a third-party app or weblink) with the diagnostic service provider 300, rather than giving directions.

Continuing with the above example, the vehicle owner has now had the scan done, which may typically and preferably be free of charge. In particular, using a scan tool or other means, the diagnostic service provider 300 has retrieved diagnostic data from the vehicle 30, which may include diagnostic trouble codes (DTC), vehicle sensor data, freeze frame data, and live data, for example, in addition to the VIN of the vehicle 30. The diagnostic service provider 300 uploads the retrieved diagnostic data to the server 200, and the server 200 derives vehicle condition information from the uploaded diagnostic data by comparing the uploaded diagnostic data with data stored in the diagnostic database(s) 400. Exemplary diagnostic methods, including the use of such diagnostic data to arrive at a most likely root cause and repair solution, are described in the following U.S. patents, each of which is owned by Innova Electronics Corporation of Irvine, Calif.: U.S. Pat. No. 6,807,469, entitled AUTO DIAGNOSTIC METHOD AND DEVICE, U.S. Pat. No. 6,925,368, entitled AUTO DIAGNOSTIC METHOD AND DEVICE, U.S. Pat. No. 7,620,484, entitled AUTOMOTIVE MOBILE DIAGNOSTICS, U.S. Pat. No. 8,068,951, entitled VEHICLE DIAGNOSTIC SYSTEM, U.S. Pat. No. 8,019,503, entitled AUTOMOTIVE DIAGNOSTIC AND REMEDIAL PROCESS, U.S. Pat. No. 8,370,018, entitled AUTOMOTIVE DIAGNOSTIC PROCESS, U.S. Pat. No. 8,909,416, entitled HANDHELD SCAN TOOL WITH FIXED SOLUTION CAPABILITY, U.S. Pat. No. 9,026,400, entitled DIAGNOSTIC PROCESS FOR HOME ELECTRONIC DEVICES, U.S. Pat. No. 9,177,428, entitled PREDICTIVE DIAGNOSTIC METHOD, U.S. Pat. No. 9,646,432, entitled HAND HELD DATA RETRIEVAL DEVICE WITH FIXED SOLUTION CAPABILITY, U.S. Pat. No. 9,824,507, entitled MOBILE DEVICE BASED VEHICLE DIAGNOSTIC SYSTEM, U.S. Pat. No. 10,643,403, entitled PREDICTIVE DIAGNOSTIC METHOD AND SYSTEM, U.S. Patent Application Pub. No. 2013/0297143, entitled METHOD OF PROCESSING VEHICLE DIAGNOSTIC DATA, U.S. Patent Application Pub. No. 2019/0304208, entitled SYSTEM AND METHOD FOR PROACTIVE VEHICLE DIAGNOSIS AND OPERATIONAL ALERT, and U.S. Patent Application Pub. No. 2019/0304213, entitled SYSTEM AND METHOD FOR PROACTIVE VEHICLE DIAGNOSIS AND OPERATIONAL ALERT, the entire contents of each of which is expressly incorporated herein by reference.

Figure 3:
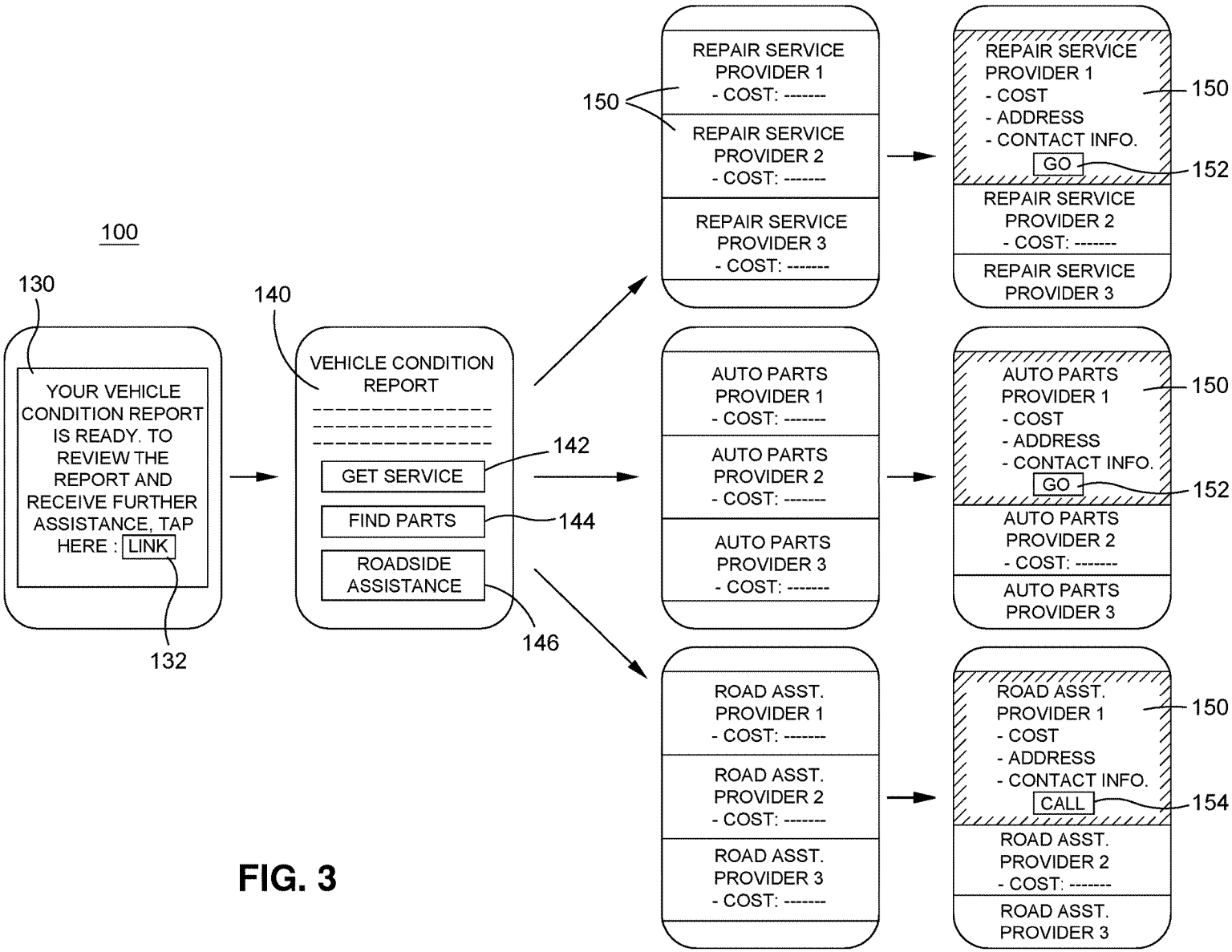
FIG. 3 shows a sequence of screenshots of the mobile application in relation to viewing vehicle condition information and requesting further assistance.

FIG. 3 shows a sequence of screenshots of the app 100 in relation to viewing vehicle condition information and requesting further assistance. Having been derived by the server 200 as described above, the vehicle condition information may be provided to the diagnostic service provider 300 according to typical diagnostic service process flows, where the diagnostic service provider 300 may use the vehicle condition information to inform the vehicle owner of a defect and/or recommend services. However, according to the exemplary system 10, the same vehicle condition information may also be provided to the vehicle owner via the app 100 in a parallel process that places the vehicle owner directly in control of the information. In the first (leftmost) view of FIG. 3, a notification 130 has been received on the vehicle owner's smartphone, which may be presented within the app 100, as a native notification of the smartphone operating system (e.g. a lock screen notification), or as a text message (e.g. SMS), for example. In the illustrated example, the notification 130 says, "Your vehicle condition report is ready. To review the report and receive further assistance, tap here:" followed by a link 132. Continuing with our example from above, the vehicle owner on the road trip may have just completed the scan at the diagnostic service provider 300 selected using the app 100 (see FIG. 2). Moments later, while he or she is still at the location of the diagnostic service provider 300 (though not necessarily so), the vehicle owner receives the notification 130 and taps the link 132.

In response to the vehicle owner's interaction with the link 132, the app 100 may display the received vehicle condition information on the vehicle owner's smartphone in the form of a vehicle condition report 140 as shown in the second (center-left) view of FIG. 3. In a case where the notification 130 is presented on the smartphone outside the app 100, the link 132 may deep link directly to the vehicle condition report 140 within the app 100. The vehicle condition information displayed in the vehicle condition report 140 may include, for example, the retrieved vehicle data, including the VIN, digital trouble codes, freeze frame data, live data, and other sensor data and identification of a most likely defect and an associated diagnostic solution derived from the diagnostic data that was retrieved from the vehicle 30. In some cases, the report may also include an estimated cost to repair the defect, along with the underlying diagnostic data itself. In reviewing the vehicle condition report 140, the vehicle owner of the above example learns that the engine's head gasket is the likely cause of the engine noise and should therefore be replaced. To assist the vehicle owner in dealing with this or any other issue indicated by the vehicle condition information, the app 100 may present to the user one or more buttons 142, 144, 146 in association with the vehicle condition report 140. Continuing with the example of the bad head gasket, the vehicle owner decides to seek a repair service to replace the head gasket and thus fix the defect. Therefore, the vehicle owner taps the "get service" button 142.

In response to the vehicle owner's interaction with the "get service" button 142, the app 100 transitions to the third (center-right) view of FIG. 3, following the uppermost of the three arrows from the second (center-left) view. The app 100 displays a list of items 150 similar to the items 120 of FIG. 2, only in this case each item 150 to a nearby repair service provider 500 (see FIG. 1) rather than a diagnostic service provider 300. From here, the vehicle owner selects between the listed repair service providers 500, possibly expanding one or more of the list items 150 for additional details as shown in the fourth (rightmost) view of FIG. 3. Unlike the diagnostic service described above, the repair service typically has a cost associated with it, so it is contemplated that each list item 150 may include a display of the cost to repair the defect, which may vary from service provider to service provider. When the vehicle owner has made his or her decision, he or she may tap the button 152 ("GO") to be directed to the selected repair service provider 500 in the same way as described above in the case of the diagnostic service provider 300. It is noted that the app 100 will use the new current geolocation of the smartphone or vehicle 30, both for compiling the list of repair service providers 500 and for directing the vehicle owner to the selected repair service provider 500, as the geolocation will often be different from what it was at the time of the vehicle owner's original instruction to initiate the scan. Because the app 100 compiles the list of repair service providers 500 according to the vehicle condition information, the particular vehicle 30, and any vehicle owner preferences, all of which may be known from the vehicle condition information and the user profile 20, the vehicle owner has the reassurance that the repair service provider 500 he or she selected is capable of fixing the defect at hand. The vehicle owner may confidently rely on the repair service provider 500 to resolve the issue (and get back to the road trip), even when in an unfamiliar area.

If the vehicle owner had been interested in replacing the head gasket by himself or herself, or wants to compare the cost of parts from different sources, the vehicle owner may have instead tapped the "find parts" button 144, in response to which the app 100 would have equivalently displayed a list of items 150 corresponding to nearby auto parts providers 500. Each auto parts provider 500 listed by the app 100 would have already been determined to have the needed part based on the vehicle condition report 140 and the particular vehicle 30. Likewise, if the vehicle owner had decided that a tow was preferable, the vehicle owner may have instead tapped the "roadside assistance" button 146. In this case, the app 100 would have displayed a list of nearby roadside assistance providers 500 capable of providing roadside assistance in relation to the particular defect indicated by the vehicle condition report 140 (and for the particular vehicle 30). In some cases, the vehicle condition information included in the vehicle condition report 140 may include an urgency level associated with the vehicle condition information for a specific vehicle. The urgency level may be displayed to the user to assist the user in choosing how, when, and where to repair the defect and, for example, whether to request roadside assistance 146. It is contemplated that the urgency level may indicate, for example, whether the vehicle 30 should be driven in its current state, such that the app 100 may advise the vehicle owner to request roadside assistance using the "roadside assistance" button 146 rather than finding and driving to a repair service provider 500 using the "get service" button 142. Conversely, for non-urgent defects, the vehicle condition report 140 may recommend that a DIYer simply order the needed part using the "find parts" button 144, rather than driving to an auto parts store.

Figure 4:
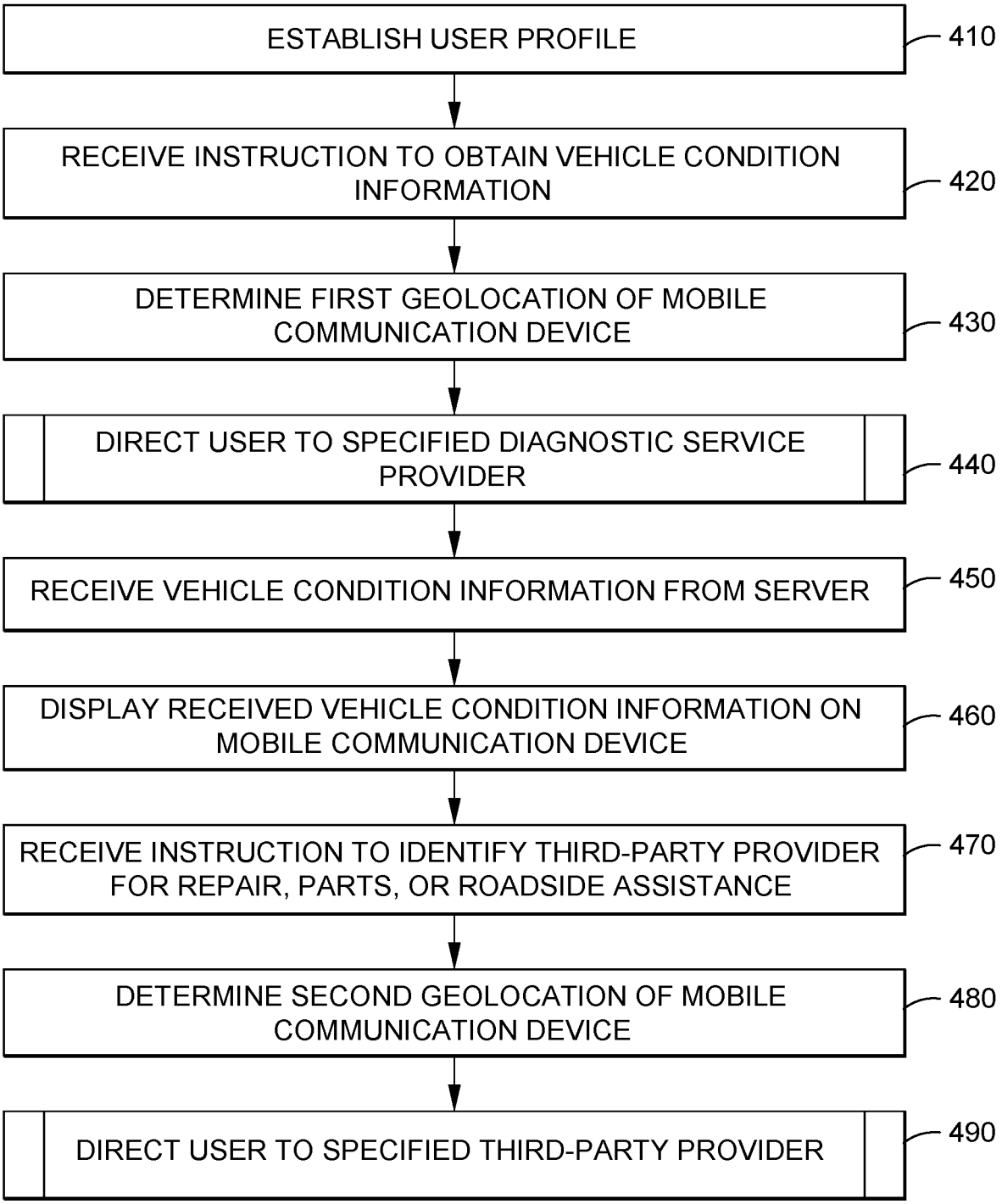
FIG. 4 shows an example operational flow according to an embodiment of the present disclosure.
Figure 5:
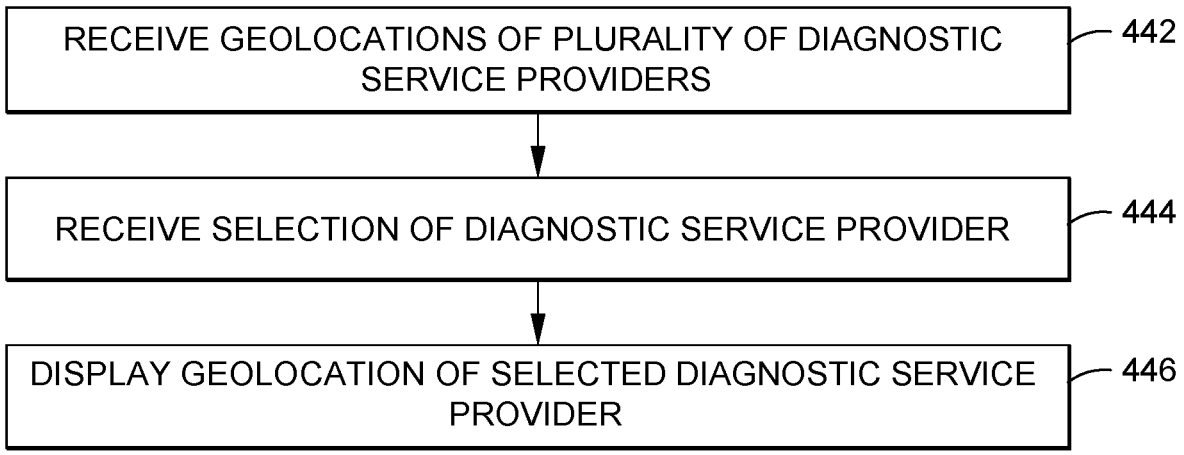
FIG. 5 shows an example sub-operational flow of step 440 in FIG. 4.
Figure 6:
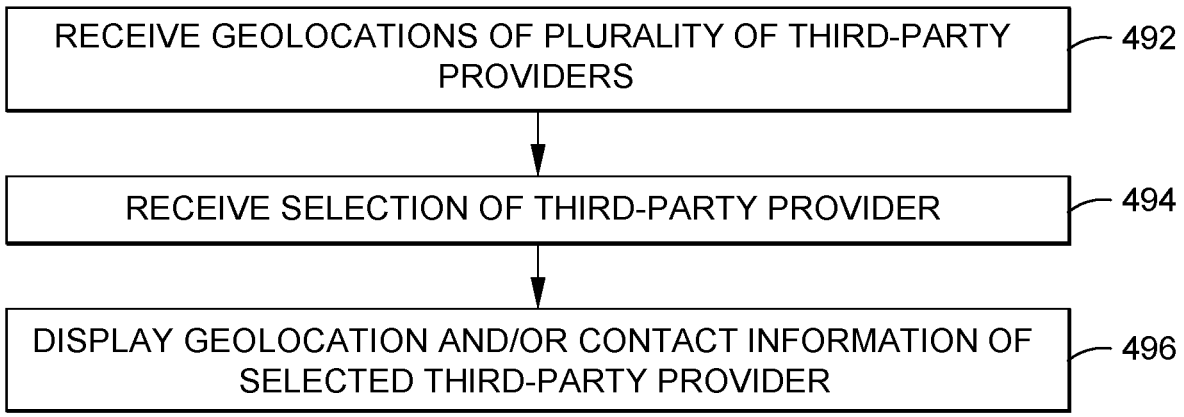
FIG. 6 shows an example sub-operational flow of step 490 in FIG. 4.

FIG. 4 shows an example operational flow according to an embodiment of the present disclosure, with FIGS. 5 and 6 showing example sub-operational flows of steps 440 and 490, respectively. The operational flow of FIGS. 4-6 may be performed, in whole or in part, by one or more elements of the system 10 shown and described in relation to FIGS. 1-3. In particular, the operational flow may be performed by the mobile application 100 installed on a smartphone or other mobile communication device 101 belonging to an owner of a vehicle 30. The operational flow may begin with establishing a user profile associated with a user of the mobile communication device 101, namely the vehicle owner (step 410). The app 100 may establish the user profile, for example, by prompting a new user to input certain information such as personal and vehicle identifying information (e.g. a VIN associated with a registered vehicle operated by the user), contact information such as an SMS-enabled phone number for receiving notifications, secure login credentials, etc. For the sake of convenience, the app 100 may allow the user to input the VIN by optically scanning a VIN bar code using the mobile communication device 101. Once all the information is input, the app 100 may communicate with the server 200 (see FIG. 1) to create and store a user profile 20 associated with the new user and the vehicle 30. As described above, the user profile 20 will grow over time to include data from any and all automotive diagnostic and service events associated with the vehicle 30, regardless of where or how the data is obtained. This may be achieved by virtue of the association of the user profile 20 with the VIN, which may thus be matched by the server 200 with incoming diagnostic data from disparate sources as described above.

With the user profile 20 having been established, the vehicle owner may begin to use the app 100 as described in relation to FIGS. 1-3. In particular, the operational flow of FIG. 4 may continue with receiving, at the mobile communication device 101, an instruction to obtain vehicle condition information (step 420). In the examples thus far described, the instruction is received via user input to the mobile communication device 101, such as by tapping a scan button 110 (see FIG. 2). However, the instruction may also be received remotely (e.g. by wireless communication) and/or automatically generated in response to a current state of the vehicle 30 as described in more detail below. At any time proximate to the receipt of the instruction to obtain the vehicle condition information (whether before or after), the operational flow may further include determining a first geolocation of the mobile communication device 101 (step 430), e.g., using cellular data and/or a GPS module included in the mobile communication device 101. This can be done at all times (e.g. periodically) or may be in response to the instruction, for example, as long as the geolocation is determined at a point in time near enough to be reliably used by the app 100.

In response to the instruction to obtain the vehicle condition information, and based on the first geolocation, the operational flow may continue with directing the user of the mobile communication device 101 to a specified diagnostic service provider having a capability to retrieve diagnostic data (including the VIN) from the vehicle 30 and upload it to the server 300 (step 440). In this regard, as represented by the sub-operational flow of FIG. 5, the app 100 may receive geolocations of a plurality of diagnostic service providers 300 in relation to the first geolocation of the mobile communication device 101 (step 442) and display a list of nearby diagnostic service providers 300 as described in relation to FIG. 2 (e.g. those diagnostic service providers 300 having a geolocation within a threshold distance or travel time as described above). The app 100 may then receive a selection of one of the diagnostic service providers 300 via user input to the mobile communication device 101 (step 444), such as by the user expanding one of the list items 120 as shown in FIG. 2. The app 100 may then display the geolocation of the selected diagnostic service provider 300 as shown in the right-most view of FIG. 2 ("ADDRESS") (step 446), thus directing the user to the selected diagnostic service provider 300. The user may further request navigation assistance using the button 122 if desired.

Once the vehicle 30 has been scanned (e.g. by the selected diagnostic service provider 300) and diagnostic data has thus been retrieved and uploaded to the server 200, the operational flow of FIG. 4 may continue with receiving the derived vehicle condition information from the server 200 (step 450). In particular, as described above, the derived vehicle condition information may be provided to the app 100 on the vehicle owner's own mobile communication device 101 in addition to being provided to the diagnostic service provider 300 who conducted the scan. This may be made possible by taking advantage of the VIN included in the uploaded diagnostic data, which can be detected from the vehicle data by the server or other processor, and matched with the owner of the vehicle 30 by querying stored user profiles 20 for a matching VIN. With the vehicle condition information having been received by the app 100, the app 100 may then display the received vehicle condition information on the mobile communication device 101 (step 460). This may be in the form of the vehicle condition report 140 described above in relation to FIG. 3, for example. As also shown in FIG. 3, it should be noted that steps 450 and 460 may be preceded by the mobile communication device 101 receiving a notification 130 that the vehicle condition information is available for review, at which time the vehicle condition information itself may be at the server 200 and not yet on the mobile communication device 101. The operational flow may then proceed with steps 450 and 460, including the retrieval of the vehicle condition information from the server 200, in response to the user's interaction with the link 132.

The operational flow of FIG. 4 may continue with receiving, at the mobile communication device 101, an instruction to identify a third-party provider for repair, parts, or roadside assistance (step 470). For example, as shown in FIG. 3, the app 100 may receive the instruction via user interaction with one or more buttons 142, 144, 146 that may be displayed in association with the vehicle condition report 140 containing the vehicle condition information. Whether the vehicle owner requests service, parts, or roadside assistance, the app 100 may provide targeted assistance as desired, taking into account the vehicle condition information, the particular vehicle 30, and any preference information of the user that may be included in the user profile 20. To this end, at any time proximate to the receipt of the instruction (whether before or after), the operational flow may further include determining a second geolocation of the mobile communication device 101 (step 480), e.g., using cellular data and/or a GPS module included in the mobile communication device 101. As described above in relation to step 430, the determination of the second geolocation of step 480 can be done at all times (e.g. periodically) or may be in response to the instruction (in this case, in response to the instruction for repair, parts, or roadside assistance), for example, as long as the geolocation is determined at a point in time near enough to be reliably used by the app 100.

In response to the instruction, the operational flow may continue with directing the user of the mobile communication device 101 to a specified third-party provider having a capability to repair a defect indicated by the vehicle condition information, having parts suitable to repair the defect, or having a capability to provide roadside assistance in relation to the defect (step 490). In this regard, as represented by the sub-operational flow of FIG. 6, the app 100 may receive geolocations of a plurality of third-party providers 500 in relation to the second geolocation of the mobile communication device 101 (step 492), which may be different from the first geolocation if the vehicle 30 has moved since the scan was requested. The app 100 may display a list of nearby third-party providers 500 as described in relation to FIG. 3 (e.g. those repair service providers, auto parts providers, and/or roadside assistance service providers having a geolocation within a threshold distance or travel time as described above). The app 100 may then receive a selection of one of the third-party providers 500 via user input to the mobile communication device 101 (step 494), such as by the user expanding one of the list items 150 as shown in FIG. 3. The app 100 may then display the geolocation and/or contact information of the selected third-party provider 500 as shown in the right-most view of FIG. 3 ("ADDRESS," "CONTACT INFO") (step 496), thus directing the user to the selected third-party provider 500. The user may further request navigation assistance using the button 152 or initiate a call using the button 154 as appropriate.

After the operational flow of FIG. 4, once the vehicle owner has transacted with the repair service provider, auto parts provider, or roadside assistance provider (collectively "third-party provider 500") that the app 100 helped find, it is contemplated that a record of the service or purchase may be uploaded by the third-party provider 500 to the server 200, which the server 200 may then store with the user profile 20. The vehicle owner may later want to view transaction information from the service or purchase event, for recordkeeping or possibly to share with another person or business. To this end, upon the vehicle owner's request or in response to some event or at a prearranged time (e.g. as a year-end report), the app 100 may receive, from the server 200 transaction information associated with a repair service rendered by an auto repair service provider, parts purchased by an auto parts provider, or roadside assistance service rendered by a roadside assistance service provider in association with the vehicle 30. The app 100 may display the transaction information on the mobile communication device 101 for use by the vehicle owner.

Along the same lines, it should be noted that the server 200 may continually store vehicle condition information as well as transaction information in the user profile 20. In this way, the user profile 20 may include a long and detailed record of the diagnostic and service events over the lifetime of the vehicle 30. At any time, the vehicle owner may wish to access this past event data, including previous received and viewed vehicle condition information. In this regard, sometime after the operational flow of FIG. 4, the app 100 may receive a user request for past vehicle condition information associated with the user profile 20. In response to the user request, the app 100 may display the vehicle condition information on the mobile communication device 101. For example, the app 100 may retrieve the requested vehicle condition information by accessing the user profile 20, which may be stored at the server 200 or other data storage location, or in some cases locally on the mobile communication device 101.

In some situations, a vehicle owner may experience vehicle trouble and may tap the scan button 110 but may not have time to get to a diagnostic service provider 300 to perform the scan. Or, the vehicle owner may intend to go immediately to the diagnostic service provider 300 but may still want more information, such as a rough diagnosis, in the meantime before getting the scan. To accommodate vehicle owners in these situations, the app 100 may further offer symptomatic vehicle diagnostic functionality. For example, upon tapping the scan button 110, the app 100 may, in addition to directing the user to a diagnostic service provider 300 in step 440, further allow the user to input to the mobile communication device 101 information identifying at least one symptom associated with the vehicle 30. For instance, the app may prompt the vehicle owner with a series of questions (e.g. does the car start? is there smoke coming out of the engine?) similar to troubleshooting. The app 100 may further access vehicle identifying information (e.g. the VIN) of the vehicle 30, either by taking it from the user profile 20 (e.g. accessed at the server 200 or on the mobile communication device 101) or receiving it as additional user input to the app 100. Based on the at least one symptom input by the user and the vehicle identifying information, the app 100 may derive symptomatic diagnostic condition information, which may not be as precise as the scan-based vehicle condition information but may still be of some value. The app 100 may display the symptomatic diagnostic condition information on the mobile communication device 101 to inform the vehicle owner. By accessing the user profile 20, the app 100 may further receive past vehicle condition information associated with the user profile 20 and derive the symptomatic diagnostic condition information further taking into account past vehicle condition information. In this way, a more targeted and potentially relevant symptomatic diagnosis can be derived with increased value for the vehicle owner.

As illustrated by the above examples, the disclosed system 10 makes it possible for a vehicle owner to obtain and accumulate vehicle condition information, which can be used to provide targeted recommendations and information to the vehicle owner over an app 100, even without owning a dongle or other data acquisition and transfer device (DAT) 102 for connecting the vehicle owner's mobile communication device 101 to a diagnostics port of the vehicle 30. However, it is also contemplated that many vehicle owners do own or are willing to buy a DAT 102. By owning a DAT 102, the vehicle owner can avoid visiting a diagnostic service provider 300 to do a scan as described above, since the vehicle owner may instead do his or her own scan using the DAT 102. As explained above, however, the same vehicle owner may at various times prefer to have the scan done by another or simply may not wish to use the DAT 102 (e.g. because of concern that it drains the vehicle battery). In order to offer an enhanced experience to users who have a DAT 102, while still providing individualized services to all vehicle owners, it is contemplated that the app 100 may have two operation modes depending on whether or not a DAT 102 will be used: a first mode that does not use the DAT 102 (and instead directs the user to a diagnostic service provider 300) and a second mode that uses the DAT 102.

In order to provide a seamless user experience, the app 100 may automatically determine whether a DAT 102 is present (see "dongle detector/switch" in FIG. 1). For example, when operative the app 100 may autonomously detect a connection between the mobile communication device 101 and the DAT 102 (e.g. a short-range wireless connection such as a Bluetooth connection). The operation mode of the app 100 may autonomously transition to the first mode in response to a determination that the DAT 102 is not present and to the second mode in response to a determination that the DAT 102 is present. Alternatively, the app may be set to the first mode, whereupon the app 100 may proceed as discussed above, including steps 430 and 440 of FIG. 4 in which the app 100 assists the vehicle owner with getting a scan from a diagnostic service provider 300 (possibly with symptomatic diagnosis in the meantime). On the other hand, when the operation mode is set to the second mode, the app 100 may omit steps 430 and 440 of FIG. 4 entirely. In this case, the app 100 may instead retrieve diagnostic data including the VIN directly from the vehicle 30 via the DAT 102 in response to the scan instruction received in step 420. The app 100 may then upload the retrieved diagnostic data from the mobile communication device 101 to the server 200, with steps 450 and onward proceeding as described above.

When the operation mode of the app 100 is set to the second mode (i.e. DAT present), it is further contemplated that the scan instruction received in step 420 may be automatically generated rather than being based on user input (e.g. tapping the scan button 110). While the DAT 102 is present and plugged into the vehicle 30, the DAT 102 may passively collect data from the vehicle 30, such as DTCs, which may be transmitted from the DAT 102 to the mobile communication device 101. The app 100 may automatically generate the first instruction based on such passively collected data. For example, the passively collected data might have an associated urgency, which can be interpreted by the app 100. In the case of an urgent DTC or other passively collected data that is considered urgent, the app 100 may automatically generate the instruction to perform the scan, which may then automatically be performed via the DAT 102 (possibly with confirmation by the vehicle owner first: "Urgent condition detected; full scan recommended: Proceed?"). Alternatively, the first instruction may be automatically generated on a periodic basis as long as the DAT 102 is present and the operation mode of the app 100 is accordingly set to mode 2. For example, the app 100 may be set to perform a full scan using the DAT 102 once per week or according to a recommended service schedule associated with the particular vehicle 30. If, at any time, the vehicle owner wishes to forgo using the DAT 102, the app 100 may automatically switch to mode 1 and recommend nearby diagnostic service providers 300 for scanning the vehicle 30.

As explained above, the user profile 20 may, over time, become a long and detailed record of the diagnostic and service events over the lifetime of the vehicle 30. It is contemplated that this accumulated information may in some cases be passed from one user profile 20 to another as the ownership of the vehicle 30 changes, with the information remaining associated with the VIN as the VIN moves to a different user profile 20. In this way, a new owner of a vehicle 30 may still be able to access past information, which may in some cases be scrubbed to remove personal or other sensitive information of prior vehicle owners.

The functionality described above in relation to the components of the system 10 and app 100 shown in FIGS. 1-3 and the operational flow described in relation to FIGS. 4-6 and throughout the disclosure may be wholly or partly embodied in one or more computers including a processor (e.g. a CPU), a system memory (e.g. RAM), and a hard drive or other secondary storage device. The processor may execute one or more computer programs, which may be tangibly embodied along with an operating system in a computer-readable medium, e.g., the secondary storage device. The operating system and computer programs may be loaded from the secondary storage device into the system memory to be executed by the processor. The computer may further include a network interface for network communication between the computer and external devices (e.g. over the Internet), such as between the mobile communication device 101 and the server 200 or between the server 200 and computers controlled by diagnostic service providers 300, third-party providers 500, etc. To the extent that functionality may be performed at the server 200 rather than by the app 100, the server 200 may comprise multiple physical servers and other computers that communicate with each other to perform the described functionality.

The above computer programs may comprise program instructions which, when executed by the processor, cause the processor to perform operations in accordance with the various embodiments of the present disclosure. The computer programs may be provided to the secondary storage by or otherwise reside on an external computer-readable medium such as a DVD-ROM, an optical recording medium such as a CD or Blu-ray Disk, a magneto-optic recording medium such as an MO, a semiconductor memory such as an IC card, a tape medium, a mechanically encoded medium such as a punch card, etc. Other examples of computer-readable media that may store programs in relation to the disclosed embodiments include a RAM or hard disk in a server system connected to a communication network such as a dedicated network or the Internet, with the program being provided to the computer via the network. Such program storage media may, in some embodiments, be non-transitory, thus excluding transitory signals per se, such as radio waves or other electromagnetic waves. Examples of program instructions stored on a computer-readable medium may include, in addition to code executable by a processor, state information for execution by programmable circuitry such as a field-programmable gate arrays (FPGA) or programmable logic array (PLA).

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A non-transitory program storage medium on which are stored instructions executable by a processor or programmable circuit of a mobile communication device to perform operations for mobile application-based vehicle diagnostics, the operations comprising:

establishing a user profile associated with a user of the mobile communication device, the profile including an SMS-enabled phone number associated with the user and a vehicle identification number (VIN) associated with a registered vehicle operated by the user;

receiving, at the mobile communication device, a first instruction to obtain vehicle condition information associated with the registered vehicle;

determining a first geolocation of the mobile communication device;

in response to the first instruction, directing the user of the mobile communication device to a specified diagnostic service provider having a capability to retrieve diagnostic data including the VIN from the registered vehicle and upload the retrieved diagnostic data to a server associated with a diagnostic database for deriving the vehicle condition information from retrieved diagnostic data, the directing including:

receiving, at the mobile communication device, a geolocation of the specified diagnostic service provider in relation to the first geolocation of the mobile communication device; and displaying the geolocation of the specified diagnostic service provider on the mobile communication device;

receiving the vehicle condition information from the server, the vehicle condition information having been derived from the diagnostic data uploaded by the specified diagnostic service provider and associated with the user based on the VIN included in the diagnostic data; and displaying the received vehicle condition information for the registered vehicle on the mobile communication device.

2. The non-transitory program storage medium of claim 1, wherein said receiving the geolocation of the specified diagnostic service provider includes receiving geolocations of a plurality of diagnostic service providers including the specified diagnostic service provider in relation to the first geolocation of the mobile communication device, the directing further includes receiving, via user input to the mobile communication device, a selection of the specified diagnostic service provider from among the plurality of diagnostic service providers, and said displaying the geolocation of the specified diagnostic service provider is in response to the selection.

3. The non-transitory program storage medium of claim 2, wherein the plurality of diagnostic service providers is determined based on the respective geolocations of the plurality of diagnostic service providers being within a threshold distance from the first geolocation of the mobile communication device.

4. The non-transitory program storage medium of claim 2, wherein the plurality of diagnostic service providers is determined based on the respective geolocations of the plurality of diagnostic service providers being within a threshold travel time of the first geolocation of the mobile communication device.

5. The non-transitory program storage medium of claim 1, wherein said displaying the vehicle condition information includes displaying an indication of an urgency level associated with the vehicle condition information.

6. The non-transitory program storage medium of claim 1, wherein the operations further comprise:

after said displaying the received vehicle condition information, receiving a user request for past vehicle condition information associated with the user profile; and, in response to the user request, displaying the vehicle condition information on the mobile communication device as past vehicle condition information.

7. The non-transitory program storage medium of claim 6, wherein the operations further comprise, in response to the user request, accessing the user profile to retrieve the vehicle condition information to be displayed as the past vehicle condition information, the vehicle condition information being stored in association with the user profile.

8. The non-transitory program storage medium of claim 7, wherein the accessing comprises accessing the user profile at the server.

9. The non-transitory program storage medium of claim 7, wherein the accessing comprises accessing the user profile on the mobile communication device.

10. The non-transitory program storage medium of claim 1, wherein the first instruction is received via user input to the mobile communication device.

11. The non-transitory program storage medium of claim 1, wherein the operations further comprise:

receiving, at the mobile communication device, a second instruction to identify an auto repair service provider to repair a defect indicated by the vehicle condition information;

determining a second geolocation of the mobile communication device; and, in response to the second instruction, directing the user of the mobile communication device to a specified auto repair service provider having a capability to repair the defect, said directing the user to the specified auto repair service provider including:

receiving, at the mobile communication device, a geolocation of the specified auto repair service provider in relation to the second geolocation of the mobile communication device; and displaying the geolocation of the specified auto repair service provider on the mobile communication device.

12. The non-transitory program storage medium of claim 11, wherein said receiving the geolocation of the specified auto repair service provider includes receiving geolocations of a plurality of auto repair service providers including the specified auto repair service provider in relation to the second geolocation of the mobile communication device, the directing further includes receiving, via user input to the mobile communication device, a selection of the specified auto repair service provider from among the plurality of auto repair service providers, and said displaying the geolocation of the specified auto repair service provider is in response to the selection.

13. The non-transitory program storage medium of claim 12, wherein the operations further comprise displaying, in association with at least one of the plurality of auto repair service providers, a cost to repair the defect.

14. The non-transitory program storage medium of claim 11, wherein the operations further comprise:

after said displaying the geolocation of the specified auto repair service provider, receiving, from the server, transaction information associated with a repair service rendered by the specified auto repair service provider in association with the registered vehicle; and displaying the transaction information on the mobile communication device.

15. The non-transitory program storage medium of claim 1, wherein the operations further comprise:

receiving, at the mobile communication device, a second instruction to identify an auto parts provider to provide auto parts for repairing a defect indicated by the vehicle condition information;

determining a second geolocation of the mobile communication device; and, in response to the second instruction, directing the user of the mobile communication device to a specified auto parts provider having parts suitable to repair the defect, said directing the user to the specified auto parts provider including:

receiving, at the mobile communication device, a geolocation of the specified auto parts provider in relation to the second geolocation of the mobile communication device; and displaying the geolocation of the specified auto parts provider on the mobile communication device.

16. The non-transitory program storage medium of claim 15, wherein said receiving the geolocation of the specified auto parts provider includes receiving geolocations of a plurality of auto parts providers including the specified auto parts provider in relation to the second geolocation of the mobile communication device, the directing further includes receiving, via user input to the mobile communication device, a selection of the specified auto parts provider from among the plurality of auto parts providers, and said displaying the geolocation of the specified auto parts provider is in response to the selection.

17. The non-transitory program storage medium of claim 16, wherein the operations further comprise displaying, in association with at least one of the plurality of auto parts providers, a cost of the parts.

18. The non-transitory program storage medium of claim 15, wherein the operations further comprise:

after said displaying the geolocation of the specified auto parts provider, receiving, from the server, transaction information associated with parts purchased from the specified auto parts provider in association with the registered vehicle; and displaying the transaction information on the mobile communication device.

19. The non-transitory program storage medium of claim 1, wherein the operations further comprise:

receiving, at the mobile communication device, a second instruction to identify a roadside assistance service provider to assist with repairing a defect indicated by the vehicle condition information;

determining a second geolocation of the mobile communication device; and, in response to the second instruction, directing the user of the mobile communication device to a specified roadside assistance service provider having a capability to provide roadside assistance in relation to the defect, said directing the user to the specified roadside assistance service provider including:

receiving, at the mobile communication device, contact information of the specified roadside assistance service provider based on the second geolocation of the mobile communication device; and displaying the contact information of the specified roadside assistance service provider on the mobile communication device.

20. The non-transitory program storage medium of claim 19, wherein said receiving the contact information of the specified roadside assistance service provider includes receiving contact information of a plurality of roadside assistance service providers including the specified roadside assistance service provider based on the second geolocation of the mobile communication device, the directing further includes receiving, via user input to the mobile communication device, a selection of the specified roadside assistance service provider from among the plurality of roadside assistance service providers, and said displaying the contact information of the specified roadside assistance service provider is in response to the selection.

21. The non-transitory program storage medium of claim 20, wherein the operations further comprise displaying, in association with at least one of the plurality of roadside assistance service providers, a cost to provide roadside assistance in relation to the defect.

22. The non-transitory program storage medium of claim 19, wherein the operations further comprise:

after said displaying the geolocation of the specified roadside assistance service provider, receiving, from the server, transaction information associated with a roadside assistance service rendered by the specified roadside assistance service provider in association with the registered vehicle; and displaying the transaction information on the mobile communication device.

23. The non-transitory program storage medium of claim 1, wherein the vehicle condition information associated with the registered vehicle includes an estimated cost associated with repairing a defect indicated by the vehicle condition information.

24. The non-transitory program storage medium of claim 1, wherein the retrieved diagnostic data includes at least one selected from a group consisting of a diagnostic trouble code (DTC), vehicle sensor data, freeze frame data, and live data.

25. The non-transitory program storage medium of claim 1, wherein the first instruction comprises a request for symptomatic diagnosis, the operations further comprising:

receiving, via user input to the mobile communication device, information identifying at least one symptom associated with the registered vehicle;

accessing vehicle identifying information of the registered vehicle;

deriving symptomatic diagnostic condition information of the registered vehicle from the at least one symptom and the vehicle identifying information; and displaying the symptomatic diagnostic condition information on the mobile communication device.

26. The non-transitory program storage medium of claim 25, said deriving the symptomatic diagnostic condition information comprises:

receiving, from the server, vehicle condition information associated with the user profile corresponding to the user; and deriving the symptomatic diagnostic condition information from the at least one symptom, the vehicle identifying information, and the vehicle condition information associated with the user profile.

27. The non-transitory program storage medium of claim 25, wherein the accessing comprises accessing the vehicle identifying information at the server.

28. The non-transitory program storage medium of claim 25, wherein the accessing comprises accessing the vehicle identifying information on the mobile communication device.

29. The non-transitory program storage medium of claim 1, wherein the operations further comprise receiving the diagnostic data from the server.

30. The non-transitory program storage medium of claim 1, wherein the operations further comprise receiving a notification on the mobile communication device that the vehicle condition information is available for review.

31. The non-transitory program storage medium of claim 30, wherein the notification contains a link, said displaying the received vehicle condition information being in response to a user interaction with the link.

32. The non-transitory program storage medium of claim 1, wherein the diagnostic data is retrieved by the specified diagnostic service provider from a vehicle diagnostic port disposed on the registered vehicle.

33. The non-transitory program storage medium of claim 1, wherein the retrieved vehicle diagnostic data comprises an OBD diagnostic payload retrieved by the specified diagnostic service provider from a vehicle diagnostic port disposed on the registered vehicle.

34. A non-transitory program storage medium on which are stored instructions executable by a processor or programmable circuit of a mobile communication device to perform operations for mobile application-based vehicle diagnostics, the operations comprising:

receiving, at the mobile communication device, a first instruction to obtain vehicle condition information associated with the registered vehicle;

determining whether a data acquisition and transfer device (DAT) for connecting the mobile communication device to a diagnostics port of a registered vehicle is present;

setting an operation mode to a first mode in response to a determination that the DAT is not present;

setting the operation mode to a second mode in response to a determination that the DAT is present;

when the operation mode is set to the first mode, determining a first geolocation of the mobile communication device and, in response to the first instruction, performing suboperations comprising:

directing the user of the mobile communication device to a specified diagnostic service provider in relation to the first geolocation, the specified diagnostic service provider having a capability to retrieve diagnostic data including a vehicle identification number (VIN) from the registered vehicle and upload the retrieved diagnostic data to a server associated with a diagnostic database for deriving vehicle condition information from retrieved diagnostic data;

receiving, at the mobile communication device, a geolocation of the specified diagnostic service provider in relation to the first geolocation of the mobile communication device; and displaying the geolocation of the specified diagnostic service provider on the mobile communication device;

when the operation mode is set to the second mode, retrieving diagnostic data including the VIN from the registered vehicle via the DAT in response to the first instruction and uploading, from the mobile communication device to the server, the diagnostic data retrieved via the DAT;

receiving the vehicle condition information from the server, the vehicle condition information having been derived from the diagnostic data uploaded either by the specified diagnostic service provider or by the mobile communication device and associated with the user based on the VIN included in the diagnostic data; and displaying the received vehicle condition information for the registered vehicle on the mobile communication device.

35. The non-transitory program storage medium of claim 34, wherein, when the operation mode is set to the second mode, the first instruction is automatically generated based on data passively collected from the registered vehicle by the DAT.

36. The non-transitory program storage medium of claim 35, further wherein, when the operation mode is set to the second mode, the first instruction is automatically generated based on an urgency associated with the passively collected data.

37. The non-transitory program storage medium of claim 35, further wherein the passively collected data includes a diagnostic trouble code (DTC).

38. The non-transitory program storage medium of claim 34, wherein, when the operation mode is set to the second mode, the first instruction is automatically generated on a periodic basis.

39. The non-transitory program storage medium of claim 34, wherein said determining whether the DAT is present comprises detecting a connection between the mobile communication device and the DAT.

40. A method of providing mobile application-based vehicle diagnostics, the method comprising:

establishing a user profile associated with a user of a mobile communication device, the profile including an SMS-enabled phone number associated with the user and a vehicle identification number (VIN) associated with a registered vehicle operated by the user;

receiving, at a mobile communication device, a first instruction to obtain vehicle condition information associated with the registered vehicle;

determining a first geolocation of the mobile communication device;

in response to the first instruction, directing the user of the mobile communication device to a specified diagnostic service provider having a capability to retrieve diagnostic data including the VIN from the registered vehicle and upload the retrieved diagnostic data to a server associated with a diagnostic database for detecting the VIN and deriving vehicle condition information from retrieved diagnostic data, the directing including:

receiving, at the mobile communication device, a geolocation of the specified diagnostic service provider in relation to the first geolocation of the mobile communication device; and displaying the geolocation of the specified diagnostic service provider on the mobile communication device;

receiving the vehicle condition information from the server, the vehicle condition information having been derived from the diagnostic data uploaded by the specified diagnostic service provider and associated with the user based on the VIN included in the diagnostic data; and displaying the received vehicle condition information for the registered vehicle on the mobile communication device.

41. A method of providing mobile application-based vehicle diagnostics, the method comprising:

establishing a user profile associated with a user of a mobile communication device, the profile including an SMS-enabled phone number associated with the user and a vehicle identification number (VIN) associated with a registered vehicle operated by the user;

enabling the mobile communication device to receive a first instruction to obtain vehicle condition information associated with the registered vehicle;

enabling the mobile communication device to determine a first geolocation of the mobile communication device;

enabling the mobile communication device to, in response to the first instruction, direct the user of the mobile communication device to a specified diagnostic service provider having a capability to retrieve diagnostic data including the VIN from the registered vehicle and upload the retrieved diagnostic data to a server associated with a diagnostic database for detecting the VIN included in the diagnostic data and deriving vehicle condition information from retrieved diagnostic data, the directing including:

receiving, at the mobile communication device, a geolocation of the specified diagnostic service provider in relation to the first geolocation of the mobile communication device; and displaying the geolocation of the specified diagnostic service provider on the mobile communication device;

enabling the mobile communication device to receive the vehicle condition information from the server, the vehicle condition information having been derived from the diagnostic data uploaded by the specified diagnostic service provider and associated with the user based on the VIN included in the diagnostic data; and enabling the mobile communication device to display the received vehicle condition information for the registered vehicle on the mobile communication device.

42. A system for providing mobile application-based vehicle diagnostics, the system comprising:

a mobile communication device having an installed mobile application, the mobile application operable to receive a first instruction to obtain vehicle condition information associated with a registered vehicle, determine a first geolocation of the mobile communication device, receive a geolocation of a specified diagnostic service provider in relation to the first geolocation of the mobile communication device in response to the first instruction, and display the geolocation of the specified diagnostic service provider on the mobile communication device; and at least one server in communication with the mobile communication device, the at least one server operable to establish a user profile associated with a user of the mobile communication device and including a vehicle identification number (VIN) associated with the registered vehicle, receive diagnostic data retrieved by the specified diagnostic service provider from the registered vehicle, detect the VIN in the diagnostic data, derive vehicle condition information from the received diagnostic data, associate the vehicle condition information with the user profile by matching the VIN included in the received diagnostic data with the VIN included in the user profile, and provide the vehicle condition information to the mobile application;

wherein the mobile application displays the vehicle condition information on the mobile communication device.

43. The system of claim 42, wherein the mobile application determines a second geolocation of the mobile communication device, and the at least one server provides the mobile communication device with a geolocation of a specified auto repair service provider in relation to the second geolocation of the mobile communication device, the specified auto repair service provider having a capability to repair a defect indicated by the vehicle condition information.

44. The system of claim 43, wherein the at least one server further provides the vehicle condition information to the specified auto repair service provider.

45. The system of claim 42, wherein the mobile application determines a second geolocation of the mobile communication device, and the at least one server provides the mobile communication device with a geolocation of a specified auto parts provider in relation to the second geolocation of the mobile communication device, the specified auto parts provider having a part suitable to repair a defect indicated by the vehicle condition information.

46. The system of claim 45, wherein the at least one server further provides the vehicle condition information to the specified auto parts provider.

47. The system of claim 42, wherein the mobile application determines a second geolocation of the mobile communication device, and the at least one server provides the mobile communication device with contact information of a specified roadside assistance service provider based on the second geolocation of the mobile communication device, the specified roadside assistance service provider having a capability to provide roadside assistance in relation to a defect indicated by the vehicle condition information.

48. The system of claim 47, wherein the at least one server further provides the vehicle condition information to the specified roadside assistance service provider.

49. The system of claim 42, wherein the at least one server further stores the vehicle condition information in the user profile.

50. The system of claim 49, wherein the mobile application is further operable to receive a user request for the vehicle condition information stored in the user profile and, in response to the user request, retrieve the vehicle condition information stored in the user profile and display the retrieved vehicle condition information on the mobile communication device.

51. The system of claim 42, wherein the first instruction is automatically generated based on an urgency level associated with information included in the user profile.

* * * * *